US009324218B2

(12) United States Patent
Stewart

(10) Patent No.: US 9,324,218 B2
(45) Date of Patent: Apr. 26, 2016

(54) PERSONAL ALARM LIGHT APPARATUS AND METHOD

(71) Applicant: Wayne Stewart, Springville, UT (US)

(72) Inventor: Wayne Stewart, Springville, UT (US)

(73) Assignee: Outback Flashlights, LLC, Orem, UT (US)

( * ) Notice: Subject to any disclaimer, the term of this patent is extended or adjusted under 35 U.S.C. 154(b) by 94 days.

(21) Appl. No.: 13/905,376

(22) Filed: May 30, 2013

(65) Prior Publication Data

US 2013/0321128 A1 Dec. 5, 2013

Related U.S. Application Data

(60) Provisional application No. 61/654,048, filed on May 31, 2012.

(51) Int. Cl.

| | |
|---|---|
| ***G08B 7/00*** | (2006.01) |
| ***F21L 4/02*** | (2006.01) |
| ***F21V 23/04*** | (2006.01) |
| *F21Y 101/02* | (2006.01) |

(52) U.S. Cl.

CPC . *G08B 7/00* (2013.01); *F21L 4/027* (2013.01); *F21V 23/0414* (2013.01); *F21Y 2101/02* (2013.01)

(58) Field of Classification Search

CPC .. F21V 33/0064; F21V 33/0076; F21L 4/005; F21L 13/06; F21Y 2101/02

USPC ..... 340/6.1; 362/208, 253

See application file for complete search history.

(56) References Cited

U.S. PATENT DOCUMENTS

| | | | |
|---|---|---|---|
| 4,348,716 | A | 9/1982 | Storm et al. |
| 4,524,534 | A | 6/1985 | Kaye et al. |
| 4,697,226 | A | 9/1987 | Verdin |
| 4,707,772 | A | 11/1987 | Jimenez et al. |
| D296,478 | S | 6/1988 | Powell et al. |
| D308,109 | S | 5/1990 | Maglica et al. |
| 5,032,824 | A | 7/1991 | Corbin |
| D376,216 | S | 12/1996 | Yuen |

(Continued)

FOREIGN PATENT DOCUMENTS

| | | |
|---|---|---|
| CA | 106540 | 6/2005 |
| DE | 20319775 | 4/2004 |

(Continued)

OTHER PUBLICATIONS http://www.garrettspecialties.com/garrity-reg-3aaa-led-flashlight-k9-p-12104.html Garrity 3AAA Flashlight K9 Web page as early as Aug. 31, 2010 from Wayback Machine.

*Primary Examiner* — Nabil Syed

(74) *Attorney, Agent, or Firm* — Clayton, Howarth & Cannon, P.C.

(57) ABSTRACT

A personal alarm light operates as a multi-purpose emergency tool having a power pack of batteries powering a white light beam, as well as a radially emanating red light ring. An audible alarm has a loud, typically high-pitched oscillating sound. A resonance chamber amplifies the sound, which emanates from apertures delivering sound radially away from the resonance chamber. Crowns on each end of the tool provide regions of reduced area and alternating relieved sections about the circumference thereof, in order to provide increased impact pressure from the points when used as hammers to break glass, or as strikers to cut through fabric or other sheet materials.

13 Claims, 5 Drawing Sheets

(56) References Cited

U.S. PATENT DOCUMENTS

| | | | | |
|---|---|---|---|---|
| 5,764,132 | A | 6/1998 | Hill | |
| 5,952,916 | A * | 9/1999 | Yamabe | 340/468 |
| D417,022 | S | 11/1999 | Chiu | |
| D420,157 | S | 2/2000 | Garrity et al. | |
| D431,874 | S | 10/2000 | Burns | |
| D443,705 | S | 6/2001 | Sanders | |
| D445,208 | S | 7/2001 | Israel et al. | |
| D465,045 | S | 10/2002 | Yamamoto et al. | |
| D486,936 | S | 2/2004 | Shiu | |
| D501,055 | S | 1/2005 | Packard | |
| D504,529 | S | 4/2005 | Vickers et al. | |
| D505,217 | S | 5/2005 | Bayat et al. | |
| D510,637 | S | 10/2005 | Chan | |
| D513,334 | S | 12/2005 | Galey | |
| D529,643 | S | 10/2006 | Kung | |
| D532,138 | S | 11/2006 | Wang et al. | |
| D538,456 | S | 3/2007 | Trigiani et al. | |
| 7,188,978 | B2 | 3/2007 | Sharrah et al. | |
| D541,454 | S | 4/2007 | Galey | |
| D544,621 | S | 6/2007 | Kim | |
| D546,491 | S | 7/2007 | Shiu | |
| D563,007 | S | 2/2008 | Opolka | |
| D567,977 | S | 4/2008 | Jianwei | |
| D567,978 | S | 4/2008 | Jianwei | |
| D568,515 | S | 5/2008 | Liu | |
| D570,511 | S | 6/2008 | Shiu | |
| D577,452 | S | 9/2008 | Shiu | |
| D580,080 | S | 11/2008 | Ho | |
| D585,577 | S | 1/2009 | Bonis | |
| D586,025 | S | 2/2009 | Bonis | |
| D593,695 | S | 6/2009 | Levine | |
| D595,439 | S | 6/2009 | Haight et al. | |
| D596,328 | S | 7/2009 | Shiu | |
| D596,772 | S | 7/2009 | Chang | |
| D599,928 | S | 9/2009 | Shiu | |
| D600,384 | S | 9/2009 | Chen | |
| D601,285 | S | 9/2009 | Chen | |
| D601,737 | S | 10/2009 | Swan | |
| 7,604,371 | B2 | 10/2009 | Bushee et al. | |
| D604,877 | S | 11/2009 | Kung | |
| 7,614,760 | B2 | 11/2009 | Sharrah et al. | |
| 7,676,981 | B2 | 3/2010 | Buckingham et al. | |
| 7,735,255 | B1 | 6/2010 | Kincaid et al. | |
| D620,627 | S | 7/2010 | Kovacik et al. | |
| D621,538 | S | 8/2010 | Bushee | |
| D629,541 | S | 12/2010 | Riley | |
| D629,542 | S | 12/2010 | Robinson | |
| D629,546 | S | 12/2010 | Deguglimo et al. | |
| 7,866,841 | B2 | 1/2011 | Bushee et al. | |
| 7,905,624 | B2 | 3/2011 | Bushee et al. | |
| D637,749 | S | 5/2011 | Bayat et al. | |
| D639,477 | S | 6/2011 | Robinson | |
| D639,478 | S | 6/2011 | Nguyen et al. | |
| D640,400 | S | 6/2011 | Huang | |
| 7,954,971 | B1 | 6/2011 | Kincaid et al. | |
| D641,093 | S | 7/2011 | Kidman | |
| D643,561 | S | 8/2011 | Maglica | |
| D644,775 | S | 9/2011 | Nguyen et al. | |
| D647,232 | S | 10/2011 | Liu | |
| D649,670 | S | 11/2011 | Robinson | |
| D659,221 | S | 5/2012 | Wu et al. | |
| D659,272 | S | 5/2012 | Nguyen et al. | |
| D659,869 | S | 5/2012 | Prieto | |
| 8,296,991 | B1 | 10/2012 | Chung | |
| D671,249 | S | 11/2012 | Sheikh et al. | |
| D672,839 | S | 12/2012 | Ding | |
| D674,943 | S | 1/2013 | Sheikh et al. | |
| D675,281 | S | 1/2013 | Speroni | |
| D675,358 | S | 1/2013 | Brands et al. | |
| D684,717 | S | 6/2013 | Hicks | |
| 8,453,369 | B1 | 6/2013 | Kincaid et al. | |
| D690,383 | S | 9/2013 | Sheikh et al. | |
| D698,056 | S | 1/2014 | Forbes et al. | |
| D700,674 | S | 3/2014 | Prieto | |
| 2002/0041139 | A1* | 4/2002 | Opolka | 313/316 |
| 2005/0168976 | A1* | 8/2005 | Chen | 362/186 |
| 2006/0077657 | A1* | 4/2006 | Vickers et al. | 362/205 |
| 2006/0139153 | A1* | 6/2006 | Adelman | 340/388.4 |
| 2007/0068058 | A1 | 3/2007 | Remo | |
| 2008/0291666 | A1* | 11/2008 | Bushee et al. | 362/206 |
| 2009/0064558 | A1 | 3/2009 | Woroner | |
| 2010/0097789 | A1 | 4/2010 | Sharrah et al. | |
| 2010/0176741 | A1 | 7/2010 | Sharrah et al. | |
| 2012/0085014 | A1 | 4/2012 | Riley et al. | |
| 2012/0180368 | A1 | 7/2012 | Haley et al. | |
| 2012/0180370 | A1 | 7/2012 | McKinley | |
| 2012/0274447 | A1* | 11/2012 | Hess | G08B 13/191 340/8.1 |
| 2014/0022770 | A1* | 1/2014 | Bertken | 362/154 |

FOREIGN PATENT DOCUMENTS

| | | |
|---|---|---|
| EM | 000188990-0001 | 4/2004 |
| EM | 000245063-0001 | 10/2004 |
| EM | 000989165-0001 | 8/2008 |
| KR | 3020020032196 | 11/2003 |

* cited by examiner

PERSONAL ALARM LIGHT APPARATUS AND METHOD

RELATED APPLICATIONS

This application: claims the benefit of U.S. Provisional Patent Application Ser. No. 61/654,048, filed on May 31, 2012; which is hereby incorporated by reference.

BACKGROUND

1. The Field of the Invention

This invention relates to lights such as flashlights and, more particularly, to novel systems and methods for lights having additional tools and alarms integral thereto.

2. The Background Art

Flashlights are used by individuals, companies, workmen, safety professionals, sports enthusiasts, hikers, backpackers, and so forth. Flashlights come in a variety of sizes, a variety of power systems, various light sources, and numerous specialty materials. Some are rechargeable. Generally they include a beacon or beam generation system such as a lightbulb powered by batteries.

Meanwhile, joggers, hikers, individuals walking through urban areas at night, individuals leaving working facilities through darkened parking lots and parking decks, and so forth may have a need for a light that is brighter, more intense, and has a better directed beam then typical flashlights. Meanwhile, an individual in a vehicle stopping at night or in an accident at night may have need various emergency functions provided by other tools.

Accordingly, it would be an advance in the art to create a flashlight system that provides additional emergency signaling including audio and visual alarm elements, as well as other safety tools that may be useful in an emergency.

SUMMARY OF THE INVENTION

In view of the foregoing, in accordance with the invention as embodied and broadly described herein, a method and apparatus are disclosed in one embodiment of the present invention as including a tool comprising a base containing a closure and at least one of an audible alarm and a crown, the crown having alternating reduced axial cross sectional area and axial relief around the circumference thereof.

The body may be configured to support a source of power portable therewith, and secured to be closed by the base. A head is typically attached for securing the source within the body and containing a light powered by the source.

At least one of the head, body, and base may further contain an actuator. Likewise, at least one of the head, body, and base may further contain a controller operably connected to the source, the alarm, the light, and the actuator for actuating the light and alarm. This is done in response to an actuation procedure executed through the controller by operation of the actuator.

A method of use may comprise providing a tool having a light, an alarm audible in the range of human hearing, and a body. The tool used in the method may further comprise an actuator, a power supply, and a controller, operably interconnected. Activating the light by the controller to operate continuously occurs in response to a first procedure applied to the actuator. Activating the alarm by the controller to operate in an alarm mode occurs in response to a second procedure, distinct from the first procedure, applied to the actuator. In certain embodiments, the method may include activating, by the controller, the light in an intermittent alarming mode coincident with operation of the alarm.

Thus, in one embodiment, a personal alarm light operates as a multi-purpose emergency tool having a power pack of batteries powering a white light beam as well as a radially emanating red light ring. An audible alarm has a loud (80-120 decibels, typical volume), high-pitched, oscillating (intermittent) sound.

A resonance chamber amplifies the sound, which emanates from apertures delivering sound radially away from the resonance chamber. Crowns on each end of the tool provide points of reduced axial cross section, precipitous edges (corners), and alternating relieved sections in order to provide increased impact pressure from the points when used as hammers to break glass, or as strikers to cut through fabric or other sheet materials.

In one embodiment of an apparatus and method in accordance with the invention, an emergency tool or flashlight may include a head, as well as a body, grip, or core area away from the head and threaded thereto. At the back end, opposite the head, a base or tail may be secured to maintain electrical connection with a power secure within the tool, while also serving other functions.

In certain embodiments of an apparatus and method in accordance with the invention, the emergency tool may be provided with various lighting systems. For example, in one embodiment, light emitting diodes, as a group, or as a single diode, may be installed behind a lens to provide a directed beam of light.

In addition, the apparatus may include a crown as part of the head providing point areas and relief areas in alternating spacing around the lens. Thus, an individual has a tool that may be used for breaking a window in a vehicle, building, or the like.

Meanwhile, the light, in addition to having white light provided in a beam directed along the axial direction, may also include a window having a filter or colored source emitting red light from the same or a different source. Thus, in certain embodiments, the light may provide not only a beam of white light, but a ring or other configuration of red light operating steadily or intermittently to signal an alarm.

In certain embodiments, the ends at the head and base ends of the tool may each have a collar presenting an increased circumference greater then that of the main body. That increased circumference provides a secure hold beyond just friction against the hand of a user. The collar circumference may also be machined or otherwise formed to have flats thereon. This will provide the tool with a tendency to stay in one location on a flat surface, rather than rolling away.

A switch may be combined with control technology, in hardware, software, or both, built into the tool in order to control the light. The switch may be actuated with a single click, multiple clicks, or by being held down. Different modes maybe initiated thereby, such as steady light, blinking light, or audible alarm sounds, respectively.

According to the difficulty or ease of manufacture, the tool may be built in more sections than simply the head, the base, and the center core or body. Additional or fewer, the light, the lens, the batteries and so forth sections may be created to hold, for example, an audio alarm.

In certain embodiments, it has been found that the audio alarm can be greatly enhanced at a given power level by creating a resonance chamber there around. By having a transducer that creates sounds, inside a resonance chamber, the tool may increase preferentially the energy of the sound waves at a particularly selected and desired frequency. Accordingly, the volume or decibel level at that preferred frequency is greatly enhanced. A comparatively high-pitched, piercing sound above the frequency range of a human voice has been found suitable and effective.

In use, the apparatus may be held in the hand as a flashlight, with the user directing the beam in a preferred direction. The beam may be directed to assist in lighting a dark area, or in blinding an assailant by providing a very bright (e.g., one-watt LED) beam. Such a beam aimed directly into the eyes of an assailant is disabling at night.

Similarly, by using a different actuation series on the switch, the tool may act as a stroboscopic light, thus providing high intensity, light emitting diode (LED) light in a stroboscopic manner. Such a light is disorienting, confusing, and blinds a person whose eyes are accustomed to the dark by introducing bright light.

Likewise, the steady or intermittent, stroboscopic, effect also may cast light through a window on the circumference of the tool. This provides light in multiple directions.

A full radial emission of light enhances the ability of the light to be seen, regardless of location. If the light is dropped or thrown it may continue to emit light for several more hours, typically eight to fifty. Similarly, because the tool has larger diameters at opposing ends (head and base) a user may grip the body of the tool more securely and easily. One may use the ends of the tool, and more particularly the machined point regions to break a window, tear through a material, or otherwise escape from or gain access to a region that is covered with glass, fabric, canvas, light gauge metal, or the like.

One may also signal by pounding on a wall, bulkhead window, or the like. For example, one may cut through upholstery and signal by pounding on the roof of a vehicle. In some embodiments, the body of the tool provides an internal support or anvil supporting the hand against collapse. Thus, the tool hardens the first of a user if so needed and supports the hand against deflection or related injury.

Meanwhile, the alternating pointed and relieved regions on each end (head and grip) of the tool also provide a contact area if the tool is used as a baton. Typically, the tool may be short, just longer then a hand breadth, and having the head and base extending out at each end of a closed fist. Thus, as a baton, the points or crown tools may be used primarily by driving each, on its end of the body acting as a "handle", directed in axial directions forward, backward, or both.

In a hammer mode, the tool may easily break glass, tear through fabrics, and leverage the force of the hands and arms of a user in striking, pounding, tearing, or cutting to create many more pounds per square inch of load and a more aggressive grip and contact cutting area than any part of the human body can generate or sustain without injury.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
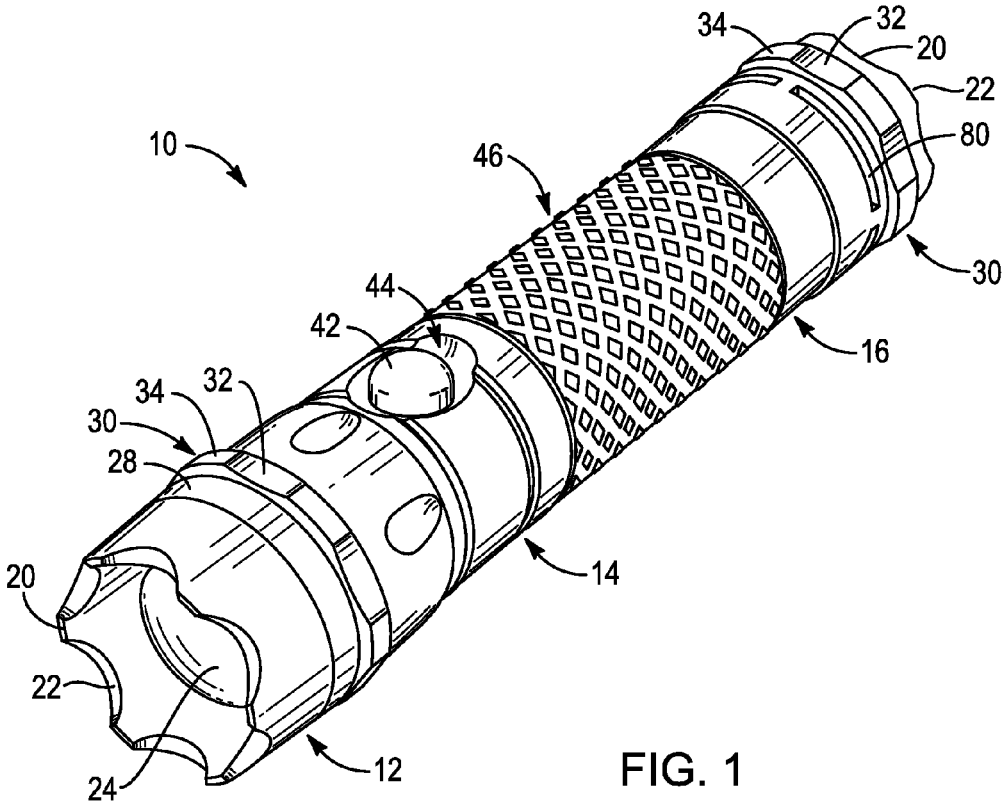
FIG. 1 is a frontal perspective view of an emergency tool in accordance with the invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Figure 2:
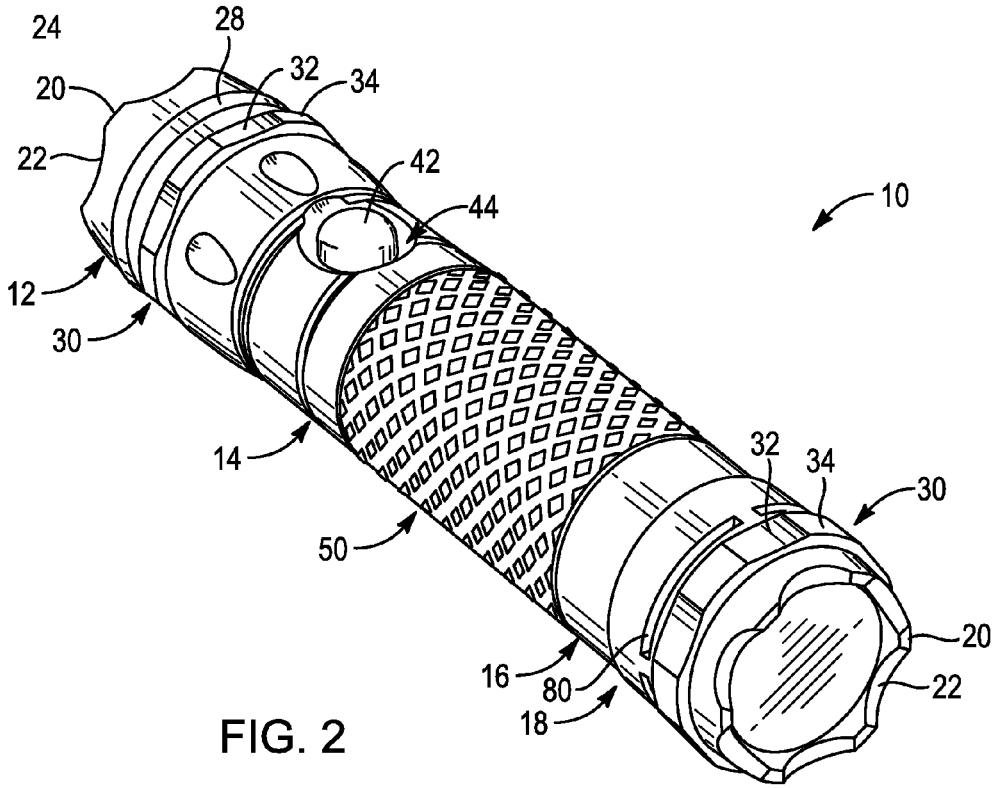
FIG. 2 is a rear perspective view thereof.

Referring to FIGS. 1-2, while referring generally to FIGS. 1-10, an emergency tool 10 may be formed to have a head 12 or head end 12 and a body 14. The body may be terminated by a base 18. However, in certain embodiments, a coupler 16 may act as an additional extension or housing to hold an audio alarm, and to form with the base 18 a resonance chamber for amplifying the sound of an audible alarm.

Figure 3:
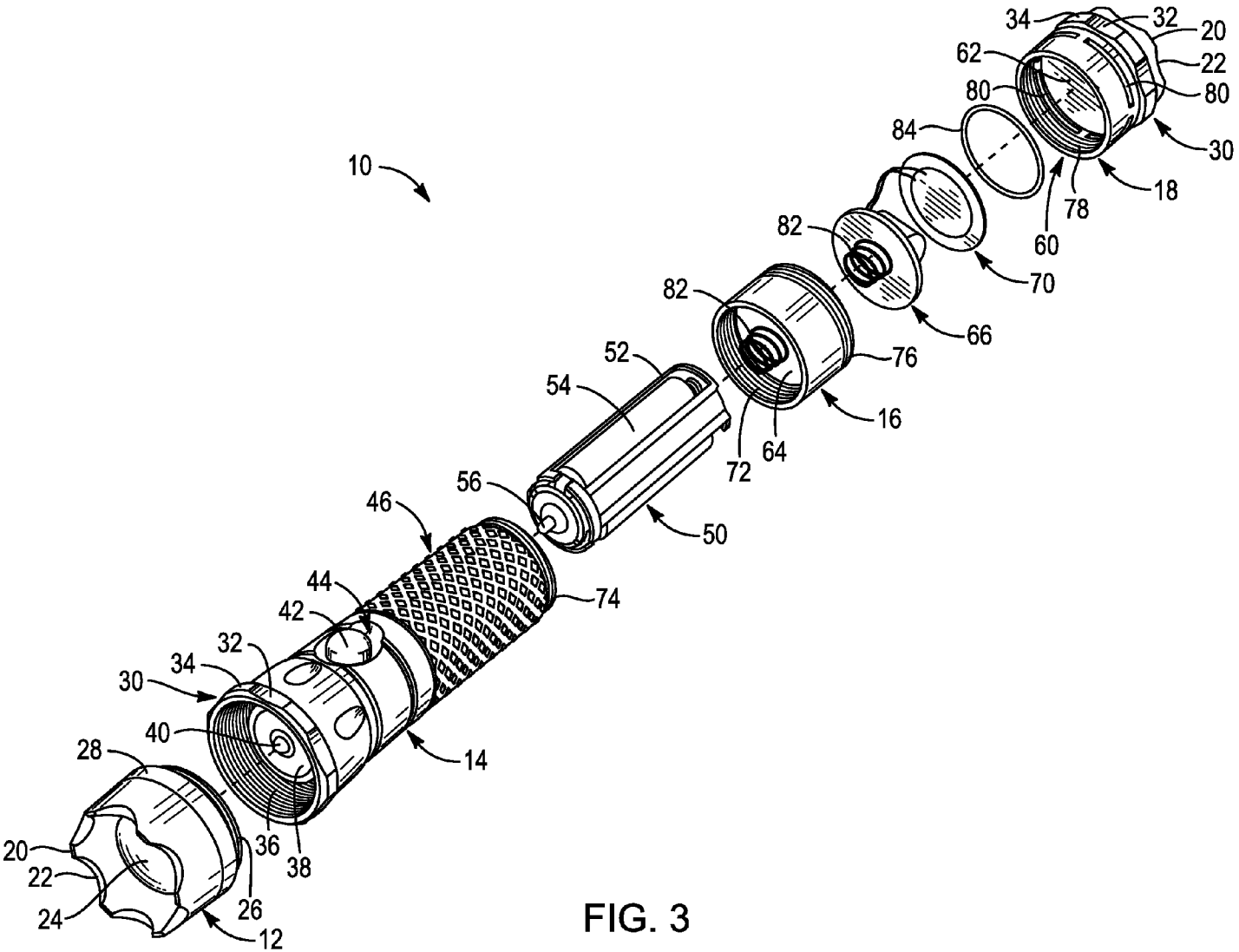
FIG. 3 is a front perspective exploded view of various component regions and elements of the tool of FIGS. 1-2.
Figure 4:
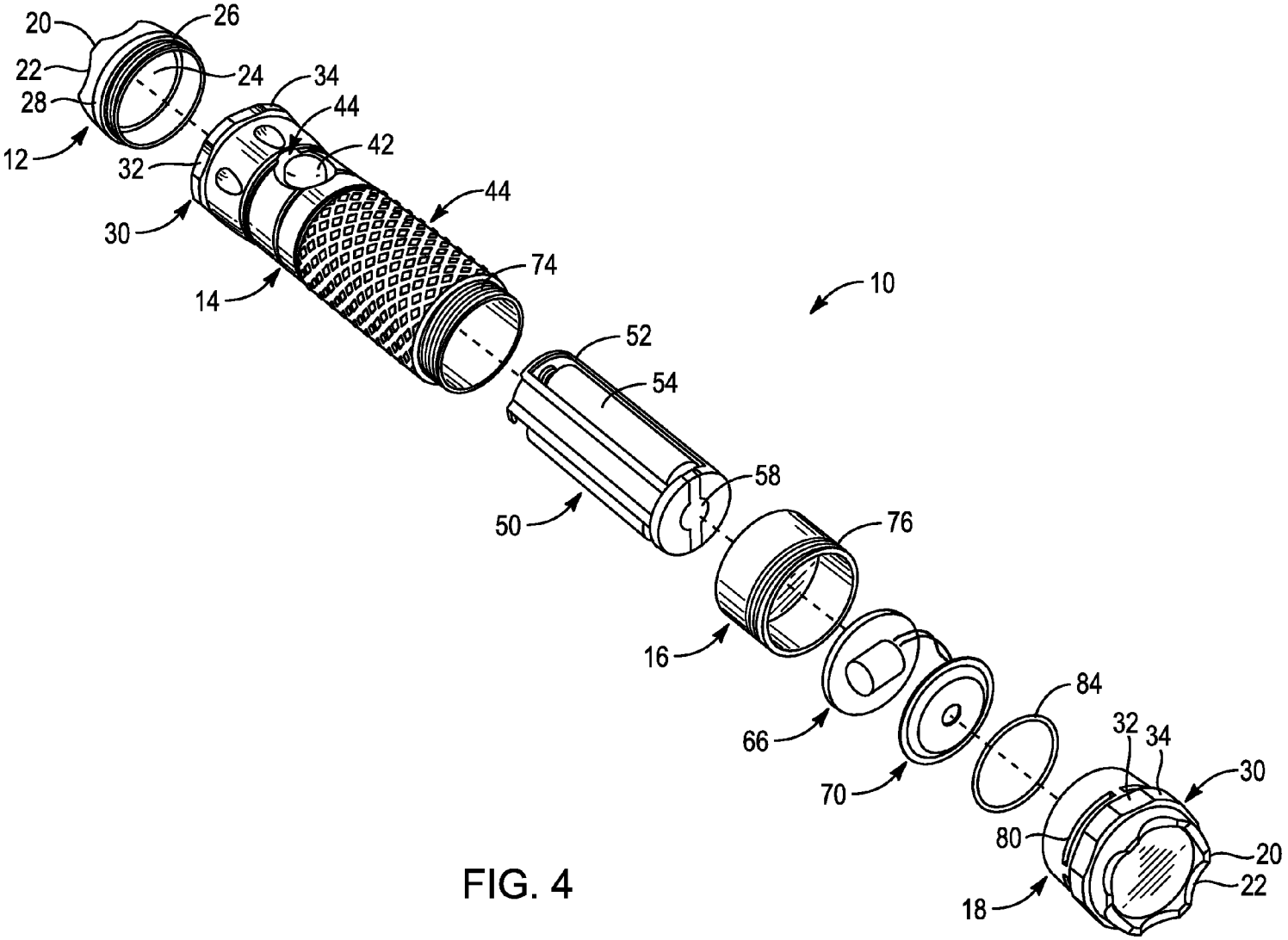
FIG. 4 is a rear perspective exploded view thereof.
Figure 5:
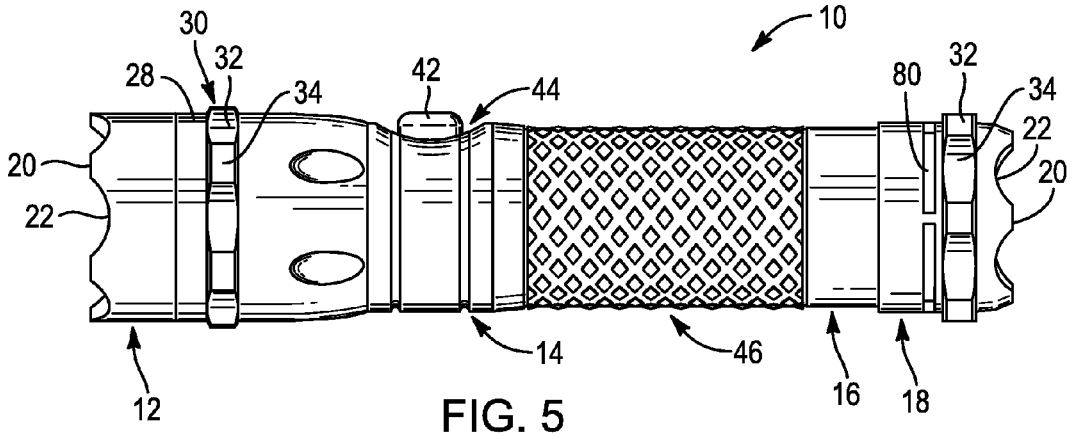
FIG. 5 is a left side elevation view thereof.
Figure 6:
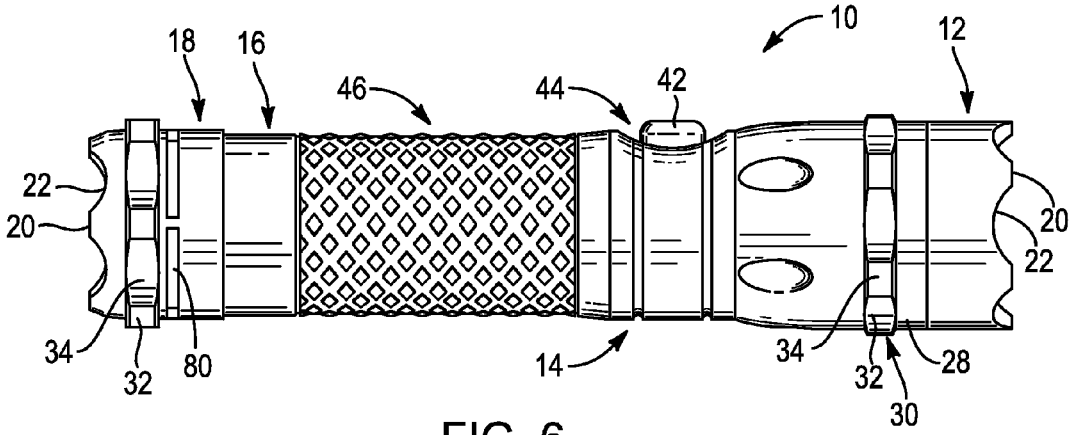
FIG. 6 is a right side elevation view thereof.
Figure 7:
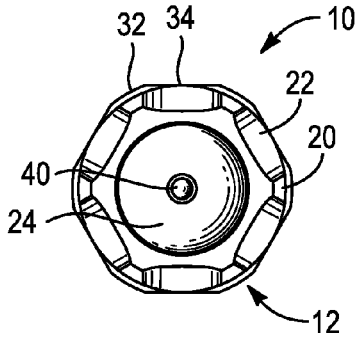
FIG. 7 is a front end elevation view thereof.
Figure 8:
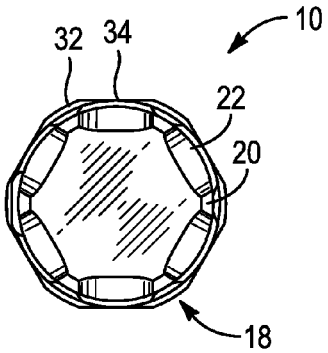
FIG. 8 is a rear end elevation view thereof.
Figure 9:
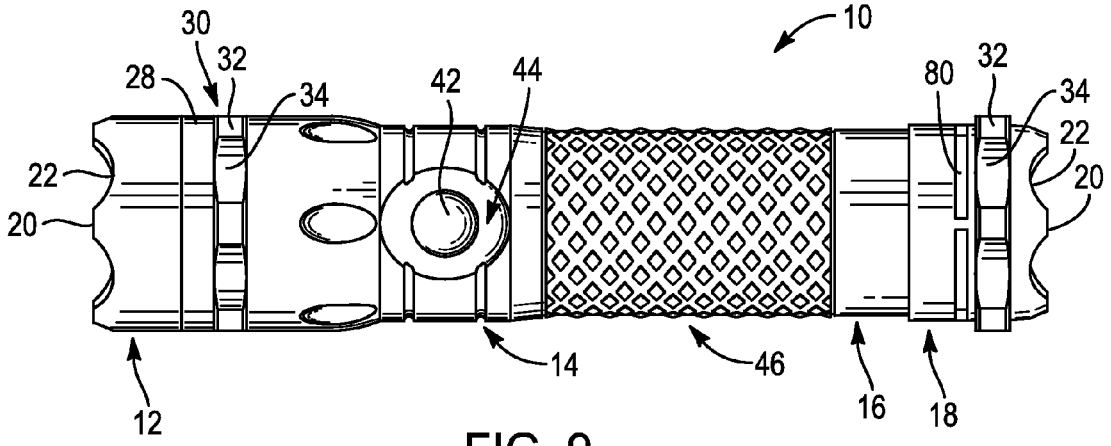
FIG. 9 is a top plan view thereof.
Figure 10:
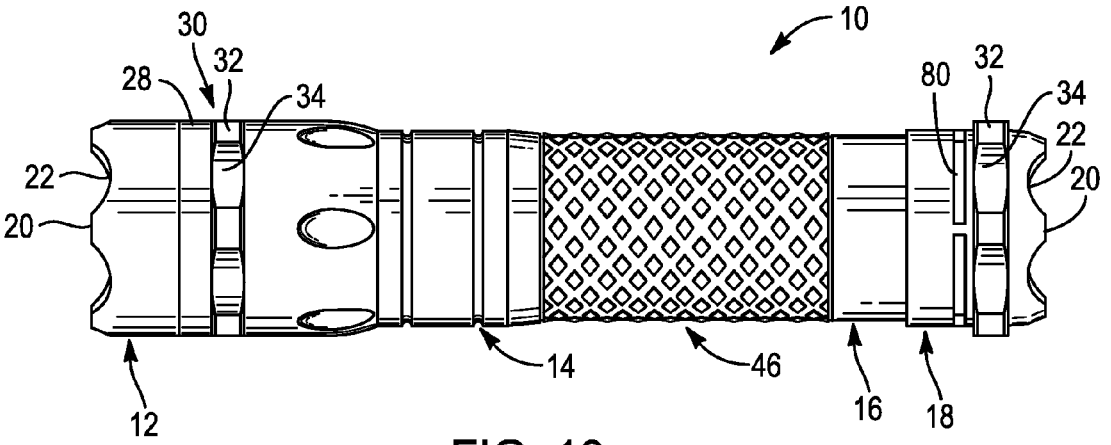
FIG. 10 is a bottom plan view thereof.

Referring to FIGS. 3-4, while continuing to refer generally to FIGS. 1-10, the emergency tool 10 may be formed with the head 12 to include a crown of points 20. Similarly, the base 18 may include a crown of points 20. In both cases, at both the head 12 and the base 18, points 20 alternate with relief 22 or relief regions 22 in order to increase the effective pressure (stress) when a user applies force by swinging the tool 10 in the hand of a user, as a hammer-like tool.

The tool 10 is not necessarily used for pounding nails or driving other fasteners. Rather, the tool 10 may be used as a baton or hammer in order to break a window in an automobile, to escape therefrom, or to break a window in an automobile, building, or the like for either escape or entry.

For example, a user in a home or fire may choose to break a window to escape to a balcony, outside feature, or the like. Similarly, a user in an automobile that has pitched into a body of water or river may use the points 20 to hammer against a windshield or side window of the automobile in order to provide a means of escape.

Similarly, an individual seeking to rescue someone in a submerged vehicle or to access a room through a locked window may hold the tool 10 as a hammer 10 or baton 10, and drive a point or points 20 against the glass in order to break the window. Narrowing the effective cross sectional area presented on each point 20, by cutting out the relief areas 22, increases the impact, the sharp edge, the stress area, per square inch (force per unit). The points can all be made more effective than bare hands, with reduced, little or (even no) risk of injury.

Therefore, in general, an emergency tool 10 may rely on the points 20 on the head 12, the base 18, or both to act as hammering elements. Notwithstanding the lack of a handle such as a hammer handle, the tool 10 may be gripped in a hand, and the hand may be swung at the end of an arm, about an elbow, about a shoulder, or both. Thus, the head end 12 and the base end 18 may both be used as striking elements.

Accordingly, the cross sectional area viewed in an axial direction along the central axis of the tool 10 is minimized to an appropriate value at each of the points 20. Also they may be machined to have a small radius (e.g., one to five mils.), less than one tenth millimeter radius.

That is, by removing the relief area 22 or removing material from the relief area 22, the smaller, axial, cross sectional, as well as the edge radius minimization area of each point, results in a substantial increase in pressure or stress (forced applied per unit area) by each point 20 in contact with any object. Thus, each point 20 may act to tear fabric, upholstery, canvas, light metal or the like, and break any brittle material in order to provide access to or escape from the binding force of such glass, fabric, sheet material, or the like.

In certain situations, a user may need to escape from a vehicle. Accordingly, one of the points 20 may be hammered against a window or windshield and provide an exit for entrapped occupants. Similarly, an individual fleeing a room of a burning building may break a window to destroy it, access a lock, or otherwise escape. Moreover, the number and durability of the points 20 provide for breaking a window directly, as well as breaking out all of the shards of the window that may remain.

Likewise, an individual coming upon an accident, such as a submerged vehicle, may grab the tool, and pound the points 20 against the glass of a window, windshield, or the like available, in order to gain access to the vehicle, and extricate any entrapped individuals.

In certain embodiments, an individual within an automobile, upon running off a road, careening out of control in an accident, or otherwise ending in a body or stream of water may reach for the tool 10, and break a window or windshield in order to escape.

For example, tempered glass will typically break into small particles, typically half inch effective diameter each. In contrast, non-tempered glass will break in long shards, which, if broken by a first or a shove, will deflect a substantial distance. Upon rupture, the shard will rake back to their original position, cutting and doing much damage, injury, or both. Thus, a sharp impact from one or more points 20 of the tool 10 provides a much safer and faster, as well as more reliable, approach to breaking into or out of a window.

Similarly, an individual seeking to rescue a child through a window that is locked, may simply shadow the window using the tool 10, gain access to a lock, and thereby open the sash, frame, or other locking mechanism.

In other situations, a user may rely on the points 20, and the fact that they may be machined to be substantially squared off, in order to rake the face of an assailant, or pound on the forehead, face, eyes, jaw, head, arm, or other available aspect of an assailant, thus inflicting pain, even while the alarm light is flashing and the alarm sound is wailing.

The tool 10 may cast a beam of light through a lens 24. The lens 24 may be mounted in place within the head 12 by the window 28. For example, the window 28 operates as a ring 28, transparent or translucent and filtering light passing radially therethrough to form a red beacon. The window 28 in the illustrated embodiment passes light in every radial direction. Thus, whenever the beam of light passes through the lense 24, light passing radially exits through the window 28, as red light. Thus, the red light provides an alarm color, which may be seen even if the light is dropped or thrown.

In the illustrated embodiment, the collar 30 is formed to have flats 32 machined thereon, or otherwise formed therein. That is, for example, the circumference 34 of the collar 30 may have flats 32 formed to interrupt its circular nature in order to resist rolling by the tool 10 on a flat surface. Likewise, the base 18 may include a collar 30, having a circumference 34 interrupted by flats 32 formed thereon. In each case, the head 12 and the base 18 have circumferences 34 that exceed the circumference of the main portion of the body 14.

By having the collars 30 at a larger diameter then the effective diameter of the body 14, the hand of a user when curled in a grip, does not have to rely exclusively on friction in order to pound with the tool 10 in an axial direction.

In general, the various components 12, 14, 16, 18 of the tool 10 may be threaded together. For example, the threads 36 mate with the threads 26 to secure the body 14 to the head 12. In fact, the body, may be formed in 1, 2, 3, or more components. In the illustrated embodiment, the body 14 actually separates toward the head end 12 away from the central portion, which also separates from a rear resonance portion 16 or coupler 16. Thus, in the illustrated embodiment, the body 14 is actually formed in 3 components as the main tubular frame of the tool 10. However, such a frame or casing may be formed in as few as two pieces, including a body and one cap.

A reflector 38 may surround a light 40. Typically, the light 40 will be a light-emitting diode (LED). Typically a high intensity LED having a power usage of from about 1 to about 5 watts may be suitable. A single watt LED has been effective. Nevertheless, a 3 watt LED is available, but provides substantially less time of lighting from a single load of batteries.

A switch 42 may be part of a larger assembly providing actuation of the light 40. The switch 42 may be advantageously located in a recess 44, which tends to provide more room for motion, at a smaller diameter. Moreover, the recess 44 may be sized to place the upper or outer surface of the switch into or below the surface of the body 14. This may be sized or resisting or preventing accidental actuation of the light 40 when the tool 10 is being stored in a glove box, purse, brief case, pocket, tool box, or the like.

The threads 74 are matched to fit the base 18, or the intermediate coupler 16. The coupler 16 holds the audio system, and serves to form a resonance chamber with the base 18. A resonance chamber has been found important in order to provide maximum sound volume from a transducer 70 contained therein.

Typically, the threads 74 fitted into the thread 72 close the body 14 to hold a power supply 50. Typically, a power supply 50 includes a frame 52 sized and appointed to retain several batteries 54. In the illustrated embodiment, 3 batteries 54 fit within the frame 52, wherein they are electrically connected in series in order to provide power out through their contacts 56, 58.

The contact 56 may be spring loaded in order to provide the tolerancing of the fit of the power supply 50 within the engagement portion of the body 14

For example, the engagement region 46 provides the bulk of the length in which the hand of a user may engage knurling, rubber gripping, a textured surface, or the like. This increases the effective frictional grip of a user on the body 14 of the tool 10. The engagement portion 46 provides increased friction, while the increased diameters of the collars 30 on the head 12 and the base 18 may each provide a stop. That is an increased diameter resists slipping by the hand of a user axially along the body 14 of the tool 10.

Referring to FIG. 4, the rear contact 58 of the power supply 50 may be shaped in any suitable manner, including the non-deflecting, flat contact surface 58 illustrated. As long as one end or the other, or an adjacent component, has a deflecting portion (e.g., the spring 82) or the front contact 56 has a spring loaded plunger, then any length adjustment may be accommodated in the tolerancing of the deflecting contact 56, 82, 92, and so forth.

In the illustrated embodiment, the coupler 16, which may actually be formed as part of the base 18 or body 14, may operate as a resonance chamber. In the illustrated embodiment, a bulkhead 62 of the base 18 forms one end wall of a resonance chamber 60. Similarly, another bulkhead 64 in the coupler 16 may form an opposite end. The diameter of the coupler 16, the length of the distance between the bulkheads 62, 64, or both will operate as "significant lengths" (resonant-frequency-determining lengths) for acoustical resonance of sounds within the chamber region 60.

It has been found that the distance between the bulkheads 62, 64 may be selected to optimize a particular frequency generated by the transducer 70 driven by the electronics 66 (e.g., controller 66 or driver 66) operating the transducer 70 at a frequency, within a range, over a range of frequencies. Accordingly, the significant lengths of diameter and length of the chamber 60, as defined by the diameter and length of the coupler 16 and base 18, as well as the length between the bulkheads 62, 64 determines a fraction of a wave length of sound that will be preferentially amplified within the chamber 60.

Thus, the resonance chamber 60 provides increased volume of sound generated by the transducer 70, and at a single or multiple preferred set of frequencies according to the significant lengths. The system 10 or tool 10 is closed up by threads 72 mating with threads 74, and the threads 76 mating with the threads 78 on the base 18. The only remaining opening to the resonance chamber 60 is a set of apertures 80 allowing radial emanation of sound at the selected frequencies from the chamber 60.

In the illustrated embodiments, springs 82 may serve as contacts 82 in order to assure electrical connection between components within the tool 10. In some embodiments, the controller 66 may be formed on the bulkhead 64 itself, thus eliminating one of the springs 82. Meanwhile, components 84 such as seals, keepers, and the like may hold the various components, such as the transducer, the controller 66, and so forth in their proper places. Likewise, other components 84 may act as seals at each threaded fitting in order to provide a seal against incursion of water, humidity, or the like.

A personal alarm light 10 was designed to operate with an audible signal of from about 80 to about 120 decibels in one prototype. The light had a flashing white strobe beam and a flashing red strobe ring casting a radial light with a one watt LED, but circuitry for supporting a three watt LED. The light included a focusing reflector and all lighting options were controlled by a single button using different sequences and delay or persistence times.

The ends of the body of the flashlight were scalloped as illustrated to provide edges that could be used to break glass, or provide self-defense if an attacker is close. Other lighting technology may be used for the light source as well. In one embodiment, the tool 10 or flashlight 10 may be used as a conventional flashlight, operated by a single click of the button to turn it on or off. The light was powered by three AAA batteries placed in a cartridge or frame.

To operate the alarm the button was pressed and held for several seconds from about 3 to about 6 seconds. The alarm can be engaged while the flashlight is either the on or off condition, since the controller is not limited to either condition for actuation thereof. Once the alarm is activated, a signal of 80 to 120 decibels in volume sounded with an audible but piercing frequency, powered by a piezoelectric transducer and augmented in certain prototype configurations by a resonance chamber tuned to maximize the volume at the chosen frequency.

A red tinted filter ring around the LED altered the color of light emitted radially from the LED, which thus appeared red from the radial direction beside the light 10 or tool 10. The light may be configured in several versions, including different light sources, light wattages, different sizes in lengths and diameters, various colors, modified barrel, body, and base designs, as well as the shape and aggressiveness of angles, edges, lengths, areas, and relief in the crown regions.

A high quality machined metal casing or structure as illustrated and described above is useful in many situations at home as well as away from home. These may include, for example, walking, jogging, camping, night stands, kitchen utility closets or drawers, on a subway, traveling by car or public transportation, or the like. The tool 10 includes no sharp blades or points, no long extensions that may qualify as weapons, yet provides light, noise, and a short baton for a user.

The alarm is turned off by holding the button down for an extremely long time, which may be selected to last from about 8 to about 60 seconds, or even more. Thus, an assailant cannot disable the alarm readily until after it has performed its function. A person in danger may activate the alarm by holding down the button for a pre-programmed time, typically only needing to be somewhat longer than a click. Up to three seconds works well, but as short as a fraction of a second is also an option easily distinguishable from a single click by adding a short but conscious persistence of pressure on the button (actuator).

Upon actuation, the flashing light illuminates by an axial beam and a radial, red light emanates out from the sides of the head. A user may aim the flashlight beam at assailant's eyes, but the alarm goes off immediately, both drawing attention of passersby, signaling others that someone is in danger or at least drawing unwanted attention to the assailant. Likewise, the alarm sound at a loud, piercing frequency is designed to startle and disorient an assailant who is not expecting it.

If a user determines to flee, he or she may carry the tool along, or may throw it away some distance, motivating an assailant to flee the area or chase the alarm to destroy it or shut it off.

Studies show that one need only delay or disrupt an attack for two to three seconds to dissuade the attacker in most instances. If an assailant is several yards away, the alarm function may be activated and the unit 10 tossed a short distance away, forcing an assailant to decide whether to continue towards the user (potential victim) or to go after the light to turn off the alarm. The assailant does not know the capacities and difficulties of disabling the tool 10, and even the time for decision or moving away from a user is sufficient to allow adequate flight for escape in the large majority of cases.

Another use for someone who gets lost or separated from a group, such as a class, camping group, or scout troop, is as a signal. A voice does not carry as well, nor last as long as the audible signal, which can be supported by the batteries for several hours. Thus, one can rely on the alarm to make a suitable alarm noise in order to be found.

In certain embodiments, the tool 10 may fit accessories such as running straps, headbands, clips for shoulder straps or purses, magnets, and the like. In certain embodiments, GPS and Bluetooth activation of cell phones may also broadcast or call in emergency signals that could be added to the tool.

The present invention may be embodied in other specific forms without departing from its fundamental functions or essential characteristics. The described embodiments are to be considered in all respects only as illustrative, and not restrictive. All changes which come within the meaning and range of equivalency of the illustrative embodiments are to be embraced within their scope.

Wherefore, I claim:

1. A tool comprising:

a base containing a closure and a plurality of points;

a crown having alternating reduced axial cross sectional area and axial relief around the circumference thereof;

a body configured to support a power source of power portable therewith, and secured to be closed by the base;

a head attached for securing the power source within the body and containing a light source powered by the power source, wherein the head also includes a lens oriented to transmit light from the light source in an axial direction, and a translucent window formed as a ring, extending around the head, such that the window transmits light from the light source in a radial direction;

a coupler connected to the base, the coupler comprising a first bulkhead and a second bulkhead to form a resonance chamber with the coupler, the first and second bulkheads spaced a selected distance apart;

a transducer operably connected to the resonance chamber to generate a frequency forming an audible alarm;

at least one of the head, body, and base further containing an actuator; and at least one of the head, body, and base further containing a controller operably connected to the power source, the transducer, the light source, and the actuator for actuating the light source and the transducer in response to an actuation procedure executed through the controller by operation of the actuator;

wherein the resonance chamber comprises at least one aperture allowing radial emanation of sound.

2. The tool of claim 1, wherein the window transmits light, from the light source, as red light.

3. The tool of claim 1, further comprising a collar connected to at least one of the head and the base, wherein the collar has flats integrally formed therein.

4. The tool of claim 1 wherein the light source is a light-emitting diode.

5. A tool comprising:

a base containing a closure, an audible alarm, and a plurality of points;

a tubular coupler connected to the base for amplifying the sound of the alarm, the coupler comprising a first bulkhead and a second bulkhead forming a resonance chamber, the first and second bulkheads being spaced a selected distance apart to optimize a particular frequency generated by a transducer, the transducer being operably connected to the resonance chamber to broadcast sound radially from an aperture in the resonance chamber;

a crown having scalloped relief around the circumference thereof;

a body configured to support a source of power portable therewith, and secured to be closed by the base;

a head attached for securing the power source within the body and containing a light source powered by the source, wherein the head further comprises a collar connected to the head with flats integrally formed in the collar, a lens oriented to transmit light from the light source in an axial direction, and a translucent window formed as a ring, extending around the head, such that the window transmits light from the light source in a radial direction;

at least one of the head, body, and base further containing an actuator; and at least one of the head, body, and base further containing a controller operably connected to the power source, the alarm, the light source, and the actuator for actuating the light source and alarm in response to an actuation procedure executed through the controller by operation of the actuator.

6. A method comprising:

providing a tool having a light source, an audible alarm allowing radial emanation of sound in the range of human hearing, a body, an actuator, a power supply, a controller operably interconnected with the actuator and the power supply, a transducer, and a resonance chamber, the resonance chamber comprising a coupler, a first bulkhead, and a second bulkhead, the first and second bulkheads spaced a selected distance apart and connected to the coupler to optimize a particular frequency generated by the transducer, wherein the transducer is operably connected inside the resonance chamber and the resonance chamber includes at least one aperture to allow radial emanation of sound from the resonance chamber;

activating the light source by the controller to operate continuously in response to a first procedure applied to the actuator; and activating the alarm by the controller to operate in an alarm mode in response to a second procedure, distinct from the first procedure, applied to the actuator; and activating, by the controller, the light source in an intermittent alarming mode coincident with operation of the alarm.

7. The method of claim 6, further comprising:

the providing the tool, further comprising a plurality of points integrally formed with at least one of a head and a base of the tool; and hammering an object with the plurality of points.

8. The method of claim 6 wherein the activating the light source produces a red, strobing light.

9. The method of claim 6, further comprising:

activating the alarm with the use of the resonance chamber.

10. The method of claim 9 wherein the activating the alarm produces a sound of from about 80 to 120 decibels.

11. The method of claim 9 wherein the activating the alarm produces a sound above the frequency range of a human voice.

12. The method of claim 9, further comprising:

tossing the tool a short distance to avoid a confrontation.

13. The method of claim 9, further comprising:

signaling to a passerby by at least one of a light from the light source and a sound from the alarm.

* * * * *